United States Patent [19]

Ishizaki et al.

[11] Patent Number: 4,509,954

[45] Date of Patent: Apr. 9, 1985

[54] METHOD FOR IMPROVING COLD FLOW OF FUEL OILS

[75] Inventors: Takaharu Ishizaki, Nishinomiya; Tsuneo Kimura, Kitasoma; Shingo Yamazaki, Amagasaki, all of Japan

[73] Assignee: Nippon Oil and Fats Company, Ltd., Tokyo, Japan

[21] Appl. No.: 575,797

[22] Filed: Feb. 1, 1984

[30] Foreign Application Priority Data

Feb. 16, 1983 [JP] Japan ..... 58-22904

[51] Int. Cl.[3] ..... C10L 1/22

[52] U.S. Cl. ..... 44/62; 44/66; 44/71

[58] Field of Search ..... 44/71, 62, 66

[56] References Cited

U.S. PATENT DOCUMENTS

| | | | |
|---|---|---|---|
| 2,854,323 | 9/1958 | Shen et al. | 44/71 |
| 3,240,575 | 3/1966 | Miller et al. | 44/71 |
| 3,638,349 | 1/1972 | Wisotsky et al. | 44/62 |
| 3,792,983 | 2/1974 | Tunkel et al. | 44/62 |
| 3,841,850 | 10/1974 | Aaron et al. | 44/62 |
| 3,883,318 | 5/1975 | Feldman et al. | 44/62 |
| 4,153,422 | 5/1979 | Wisotsky | 44/62 |
| 4,163,645 | 8/1979 | Cheng et al. | 44/62 |
| 4,297,107 | 10/1981 | Boehmke | 44/56 |
| 4,404,000 | 9/1983 | Toyoshima et al. | 44/62 |
| 4,419,106 | 12/1983 | Miller | 44/62 |

*Primary Examiner*—Y. Harris-Smith

*Attorney, Agent, or Firm*—Parkhurst & Oliff

[57] ABSTRACT

The cold flow of fuel oils is improved by adding esters of addition products of epoxides of specifically limited nitrogen-containing compounds with linear saturated fatty acids or a combination of the esters and polymers of one or more monomers selected from the group consisting of olefins, alkyl esters of ethylenically unsaturated carboxylic acids and vinyl esters of saturated fatty acids to fuel oils.

8 Claims, No Drawings

METHOD FOR IMPROVING COLD FLOW OF FUEL OILS

BACKGROUND OF THE INVENTION

1. Field of the Invention

The present invention relates to a method for improving the cold flow of hydrocarbon fuel oils.

2. Description of the Prior Art

Since the oil crisis, a variety of sources for fuel oils have been used and the ratio of the amount of light crude oils has been reduced and it is therefore thought that the use of heavy crude oils will increase in the future. On the other hand, the demand for middle distillate fuel oils tends to be increased in view of the regulation of sulfur oxide exhaust. Therefore, if it is intended to obtain fuel oils from heavy crude oils containing a large amount of paraffins having high molecular weight through fractional distillation, it is necessary to remove the distillate fraction of high boiling points. As a result, the paraffin content having high molecular weight is increased in the distilled fuel oils.

In such fuel oils, crystals of paraffin are more apt to be precipitated and grown at a low temperature than in conventional fuel oils and the fluidity of the fuel oil is thereby lowered. Furthermore, large paraffin crystal grains form at a temperature at which the fluidity is maintained and filters in the fuel supply system and piping in diesel engines, etc. become plugged and the flowing of fuel oils is inhibited.

For solving these problems, a large number of cold flow improvers of fuel oils have been proposed, for example, condensation products of chlorinated paraffin and naphthalene (U.S. Pat. No. 1,815,022), polyacrylates (U.S. Pat. No. 2,604,453), polyethylenes (U.S. Pat. No. 3,474,157), copolymers of ethylene and propylene (French Pat. No. 1,438,656) and copolymers of ethylene and vinyl acetate (U.S. Pat. No. 3,048,479) and the like.

When these cold flow improvers are added to fuel oils, they show an excellent function for lowering the pour point in a pour point test (JIS K 2269) but in many cases have substantially no effect in a cold filter plugging point test (abbreviated as CFPP test hereinafter) by which the plugging of a filter in the fuel supply system at low temperatures is judged. The improvers which are effective with fuel oils containing a large amount of paraffin of high molecular weight, are few.

The pour point test cannot forecast the plugging of the filter in the fuel supply system due to paraffin crystal grains formed at a temperature higher than the pouring point but the CFPP test can serve to forecast this phenomenon and is presently widely used.

There has been proposed in EPC Laid-Open Specification No. 0085803 a cold flow improver capable of effectively lowering the CFPP of fuel oils. However, this cold flow improver has drawbacks, for instance the improver has a high melting point and is hardly soluble in fuel oils.

SUMMARY OF THE INVENTION

The present invention relates to a cold flow improver free from the above described drawbacks. It was found that when specific esters are added to fuel oils, the CFPP is greatly lowered and that when specific polymers are used together with the specific esters, the pour point is greatly lowered together with the CFPP.

That is, one of the features of the present invention lies in a method for improving the cold flow of fuel oils, which comprises adding esters of addition products of epoxides, such as alkylene oxide, styrene oxide or glycidol, of compounds having the formula (1) with linear saturated fatty acids, to fuel oils,

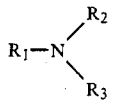

(1)

wherein $R_1$, $R_2$, and $R_3$ are H—, $CH_3(CH_2)_n$—, $CH_3(CH_2)_nCO$— (n=0~25), —$CH_2CH_2OH$, —$CH(CH_3)CH_2OH$ or —$CH_2CH(OH)CH_2OH$, and at least one of $R_1$, $R_2$ and $R_3$ is —$CH_2CH_2OH$, —$CH(CH_3)CH_2OH$ or —$CH_2CH(OH)CH_2OH$.

Another feature of the present invention lies in a method for improving the cold flow of fuel oils, which comprises adding (A) the above described esters to fuel oils together with (B) polymers of at least one monomer selected from the group consisting of olefins, alkyl esters of ethylenically unsaturated carboxylic acids and vinyl esters of saturated fatty acids.

DESCRIPTION OF THE PREFERRED EMBODIMENT

For the compounds having the formula (1), use is made of methyldiethanolamine, ethyldiethanolamine, butyldiethanolamine, octyldiethanolamine, lauryldiethanolamine, stearyldiethanolamine, behenyldiethanolamine, methyldiisopropanolamine, butyldiisopropanolamine, stearyldiisopropanolamine, methylbis(dihydroxypropyl)amine, butylbis(dihydroxypropyl)amine, stearylbis(dihydroxypropyl)amine, dimethylmono(dihydroxypropyl)amine, dibutylmono(dihydroxypropyl)amine, distearylmono(dihydroxypropyl)amine, triethanolamine, triisopropanolamine, tris(dihydroxypropyl)amine, diethanolmono(dihydroxypropyl)amine, ethanolbis(dihydroxypropyl)amine, and further dialkanolamides, which are diethanolamides or diisopropanolamides of fatty acids having 1–30 carbon atoms, such as acetic acid, propionic acid, butyric acid, hexanoic acid, octanoic acid, decanoic acid, lauric acid, myristic acid, palmitic acid, stearic acid, arachic acid, behenic acid, lignoceric acid and the like.

The alkylene oxides to be added to the compound having the formula (1) include ethylene oxide, propylene oxide, butylene oxide and the like. The number of moles of the alkylene oxide, styrene oxide or glycidol to be added to the compounds having the formula (1) is 1–100 moles, preferably 1–30 moles, per mole of the compound having the formula (1). When more than 100 moles of the oxide is added to one mole of the compound having the formula (1), the resulting addition product cannot produce a cold flow improver capable of lowering fully the CFPP of fuel oil, and cannot be satisfactorily used for practical purposes.

The linear saturated fatty acids used to form the esters include fatty acids having 10–30, preferably 20–30, carbon atoms, for example, decanoic acid, lauric acid, palmitic acid, stearic acid, arachic acid, behenic acid, lignoceric acid, cerotic acid, montanic acid, melissic acid and the like; and coconut oil fatty acids, hydrogenated beef tallow fatty acids, hydrogenated rapeseed oil fatty acids, hydrogenated fish oil fatty acids, synthetic fatty acids containing these fatty acids, and the like.

The esters to be used in the present invention can be obtained by esterifying the above described addition products of the epoxide of the compound having the formula (1) and the above described fatty acids in a usual manner.

The olefins to form the polymers are olefins having 2–30 carbon atoms, and particularly α-olefins are preferable, and they are, for example, ethylene, propylene, 1-butene, isobutene, 1-pentene, 1-hexene, 1-heptene, 1-octene, diisobutene, 1-dodecene, 1-octadecene, 1-eicosene, 1-tetracosene, 1-triacontene, etc.

Alkyl esters of ethylenically unsaturated carboxylic acids to form the polymers are esters of unsaturated carboxylic acids, such as acrylic acid, methacrylic acid, itaconic acid, crotonic acid, maleic acid, fumaric acid, etc. with saturated alcohols having 1–30 carbon atoms, such as methyl alcohol, ethyl alcohol, n-propyl alcohol, isopropyl alcohol, n-butyl alcohol, isobutyl alcohol, isoamyl alcohol, n-hexyl alcohol, 2-ethylhexyl alcohol, n-octyl alcohol, n-decyl alcohol, lauryl alcohol, myristyl alcohol, cetyl alcohol, stearyl alcohol, behenyl alcohol, 3-methylpentadecyl alcohol, tricosyl alcohol, pentacosyl alcohol and oxo alcohols.

Saturated fatty acid vinyls to form the polymers are vinyl esters of saturated fatty acids having 1–30 carbon atoms, for example, vinyl formate, vinyl acetate, vinyl propionate, vinyl butyrate, vinyl hexanoate, vinyl octanoate, vinyl decanoate, vinyl laurate, vinyl myristate, vinyl palmitate, vinyl stearate, vinyl behenate, vinyl lignocerate, vinyl melissate, etc.

The polymers to be used in the present invention are obtained by polymerizing one or a mixture of two or more of the above described monomers in a usual manner or by esterifying the polymers of ethylenically unsaturated carboxylic acids with alcohols. The number average molecular weight of the polymers is preferred to be 500–50,000.

In the present invention, when it is intended mainly to lower the CFPP, the above described esters can be added to fuel oils to obtain this objective.

When it is intended to lower both the CFPP and the pour point, this object can be attained by adding the above described esters and the above described polymers to fuel oils. The mixture ratio of the esters to the polymers is 1:9–9:1 (weight ratio) in order to effectively lower both the CFPP and the pour point.

The total amount of the esters, or the esters and the polymers to be added to fuel oils according to the present invention is 10–5,000 ppm by weight, preferably 50–1,000 ppm and if less than 10 ppm is added, the satisfactory effect cannot be obtained, and if the amount exceeds 5,000 ppm, the effect is not improved and the addition of such an amount is not economically advantageous.

In the present invention, antioxidants, corrosion preventing agents, other cold flow improvers, which are generally added to fuel oils, may be used together.

The present invention can greatly lower the CFPP and the pour point of fuel oils, so that various problems regarding the cold flow in storage and the transport of distillate fuel oils having a relatively high boiling point, which contain paraffin of high molecular weight, can be solved. The fuel oils are usable even to fractions of high boiling points.

The present invention will be explained in more detail.

The following examples are given for the purpose of illustration of this invention and are not intended as limitations thereof.

EXAMPLE 1

Into an autoclave of 1 l capacity were charged 149 g (1.0 mole) of triethanolamine and 4.5 g (0.3% by weight) of KOH, and the resulting mixture was heated at 100°–110° C. for 1 hour to remove water. Then, ethylene oxide (EO) was added to the triethanolamine at 140° C. for 2 hours. The addition amount of EO was 5.6 moles.

Then, 316.3 g (0.8 mole) of the resulting EO addition product of triethanolamine and 828 g (2.4 moles) of behenic acid (acid value: 162.6) were subjected to an esterification reaction in the presence of 5.7 g (0.5% by weight) of p-toluenesulfonic acid at 140°–160° C. for 10 hours under a nitrogen atmosphere while removing distilled water, to obtain a behenic acid triester of the 5.6 mole EO addition product of triethanolamine, which triester was cold flow improver No. 1 of the present invention listed in the following Table 1. The resulting cold flow improver No. 1 of the present invention had an acid value of 14.7 and a hydroxyl value of 20.2.

According to the above described reaction, cold flow improver Nos. 2–15 of the present invention listed in Table 1 were produced.

In order to evaluate the solubility and the CFPP lowering ability of the cold flow improver of the present invention, each of cold flow improver Nos. 1–15 of the present invention and conventional cold flow improver Nos. 16–35 was added to a gas oil fraction produced from a Middle East crude oil having the properties noted below, and the solubility of the cold flow improvers in the gas oil fraction and the CFPP of the gas oil fraction containing the improver were measured. The obtained results are shown in Table 1.

The solubilities were estimated in the following manner. A 10% xylene solution of a cold flow improver according to the present invention or of a conventional cold flow improver was prepared and added to the gas oil fraction at room temperature such that the gas oil fraction would contain 100 ppm of the cold flow improver. When the improver was dissolved in the gas oil fraction within 10 seconds, the solubility of the improver was estimated to be good (o); when the improver was dissolved in a time of from 10 to 60 seconds, the solubility thereof was estimated to be somewhat poor (Δ); and when the improver was precipitated, the solubility thereof was estimated to be poor (x).

Properties of gas oil fraction:

| | |
|---|---|
| (1) Boil point range | |
| Initial boiling point | 225° C. |
| 20% distilled point | 280° C. |
| 90% distilled point | 352° C. |
| End point | 373° C. |
| (2) Pour point | −5° C. |
| (3) CFPP | 0° C. |

TABLE 1

| | No. | Cold flow improver: Compound having the formula (1) | Addition component: Kind[1] | Addition component: Number of moles | Esterified fatty acid: Fatty acid | Esterified fatty acid: Number of moles | Addition amount (ppm) | Solubility[2] | CFPP[3] (°C.) |
|---|---|---|---|---|---|---|---|---|---|
| Cold flow improver of this invention | 1 | triethanolamine | EO | 5.6 | behenic acid | 3 | 200 | o | −11 |
| | 2 | triethanolamine | EO | 5.6 | behenic acid | 1 | 200 | o | −9 |
| | 3 | triethanolamine | EO | 25 | behenic acid | 3 | 200 | o | −9 |
| | 4 | methyldiethanolamine | EO | 9.1 | hydrogenated rapeseed oil fatty acid | 2 | 200 | o | −7 |
| | 5 | triethanolamine | EO | 4.6 | arachic acid | 3 | 200 | o | −10 |
| | 6 | triisopropanolamine | PO | 13.2 | stearic acid | 3 | 200 | o | −6 |
| | 7 | tris(dihydroxy-propyl)amine | EO | 6.0 | stearic acid | 4 | 200 | o | −6 |
| | 8 | behenyldiethanol-amine | EO | 10.5 | coconut oil | 2 | 200 | o | −5 |
| | 9 | diethanolamide of behenic acid | EO | 14.4 | behenic acid | 2 | 200 | o | −6 |
| | 10 | triethanolamine | EO / PO | 6.0 / 2.0 (random) | behenic acid | 3 | 200 | o | −10 |
| | | triethanolamine | EO / PO | 8.0 / 2.0 (blocked) | behenic acid | 3 | 200 | o | −10 |
| | 12 | ethyldiethanolamine | SO | 5.8 | behenic acid | 3 | 200 | o | −8 |
| | 13 | triethanolamine | GC | 6.2 | behenic acid | 3 | 200 | o | −8 |
| | 14 | behenyldiethanol-amine | GC | 5.7 | synthetic[4] fatty acid | 3 | 200 | o | −8 |
| | 15 | ethanolbis-(dihydroxypropyl)-amine | EO | 12.2 | arachic acid | 4 | 200 | o | −9 |
| Comparative cold flow improver | 16 | triethanolaminetriester of behenic acid | | | | | 200 | x | −11 |
| | 17 | methyldithanolaminediester of hydrogenated rapeseed oil fatty acid | | | | | 200 | x | −7 |
| | 18 | tris(dihydroxypropyl)aminetetraester of stearic acid | | | | | 200 | x | −6 |
| | 19 | triisopropanolaminetriester of stearic acid | | | | | 200 | x | −5 |
| | 20 | behenyldiethanolaminediester of coconut oil fatty acid | | | | | 200 | Δ | −3 |
| | 21 | triethanolaminetriester of stearic acid | | | | | 200 | x | −1 |
| | 22 | triethanolaminemonoester of stearic acid | | | | | 200 | x | −1 |
| | 23 | triethanolaminetriester of palmitic acid | | | | | 200 | x | 0 |
| | 24 | triethanolaminediester of rapeseed oil fatty acid | | | | | 200 | o | 0 |
| | 25 | triethanolaminetriester of oleic acid | | | | | 200 | o | 0 |
| | 26 | triethanolaminemonoester of oleic acid | | | | | 200 | o | 0 |
| | 27 | triethanolamine salt of behenic acid | | | | | 200 | x | 2 |
| | 28 | behenyldiethanolamine | | | | | 200 | x | 0 |
| | 29 | diethanolamide of behenic acid | | | | | 200 | x | 0 |
| | 30 | addition product of 10.5 moles of EO to 1 mole of behenyldiethanolamine | | | | | 200 | x | 0 |
| | 31 | addition product of 5.7 moles of GC to 1 mole of behenyldiethanolamine | | | | | 200 | x | 0 |
| | 32 | addition product of 14.4 moles of EO to 1 mole of diethanolamide of behenic acid | | | | | 200 | x | 0 |
| | 33 | commercially available cold flow improver A (chlorinated paraffin-naphthalene condensate) | | | | | 500 | o | 0 |
| | 34 | commercially available cold flow improver B (polylauryl acrylate, average molecular weight: 3,000) | | | | | 500 | o | 0 |
| | 35 | commercially available cold flow improver C (polymyristyl methacrylate, average molecular weight: 20,000) | | | | | 500 | o | −1 |

Note
[1]EO: ethylene oxide, PO: propylene oxide, SO: styrene oxide, GC: glycidol
[2]Solubility: o: good, Δ: somewhat poor, x: poor
[3]Measured according to IP 309/76
[4]Synthetic fatty acid: mixed fatty acids having 21–29 carbon atoms, acid value 140, iodine value: 2, melting point: 63° C.

EXAMPLE 2

The pour point and the CFPP of fuel oils, to which the ester and the polymer according to the present invention had been added, were evaluated.

Explanation will be made with respect to polymers to be used in this example hereinafter.

Polymer 1 is a copolymer of ethylene and vinyl acetate. ACP-430 (made by Allied Chemical Co., United States of America, number average molecular weight: 3,500, ratio of vinyl acetate: 29% by weight).

Polymer 2 is the product of the following process: a mixture of 47 g of copolymer of ethylene and acrylic acid, ACP-5120 (made by Allied Chemical Co., United States of America, number average molecular weight: 3,500, acid value: 120), 45 g of lauryl alcohol, 0.2 g of paratoluene sulfonic acid and 100 g of xylene was subjected to an esterification reaction for 10 hours by refluxing xylene under a nitrogen blanket while distilling off water, then reaction mass was gradually introduced into an excess amount of methanol and then the precipitate was filtered off and dried.

Polymer 3 is the project of the following process: while heating a mixture of 339 g (1.0 mole) of α-olefin having 20–28 carbon atoms, 98 g (1.0 mole) of maleic anhydride and 500 g of xylene under nitrogen atmosphere so as to reflux xylene, a solution of 4 g of di-t-butyl peroxide dissolved in 50 g of xylene was gradually added thereto and the polymerization reaction was continued for 10 hours under these conditions then 273 g (2.1 moles) of 2-ethylhexyl alcohol and 2 g of paratoluenesulfonic acid were added thereto and the esterification reaction was carried out for 10 hours and then xylene was distilled off.

Polymer 4 a branched polyethylene, ACP-1702 (made by Allied Chemical Co., United States of America, number average molecular weight: 1,100, specific gravity: 0.88).

Polymer 5 is polyalkyl methacrylate, Acryloid 152 (made by Rohm and Haas Company, number average molecular weight: 17,000, number of carbon atoms in alkyl group: 12–20).

Polymer 6 is an ethylene-propylene copolymer having a propylene content of 42 mol% and an average molecular weight of about 100,000 (synthesized according to Reference example 2 of Japanese Patent Application Publication No. 23,512/65).

The esters and polymers to be used in the present invention were added in combination as a cold flow improver to a heavy gas oil fraction having the following properties which had been produced from the Middle East crude oil and had a slightly high boiling point and a narrow boiling point range. Once the improvers were added to the heavy gas oil fraction the pour points and the CFPP of the heavy gas oil fraction containing the ester and the polymer were measured. The obtained results are shown in the following Table 2.

Properties of heavy gas oil fraction:

| | |
|---|---|
| (1) Boiling point range | |
| Initial boiling point | 227° C. |
| 20% distilled point | 290° C. |
| 90% distilled point | 343° C. |
| End point | 360° C. |
| (2) Pour point | −2.5° C. |
| (3) CFPP | 0° C. |

As seen from Table 1, heavy gas oils containing a combination system (cold flow improver Nos. 35–45) of the ester and the polymer of the present invention as a cold flow improver are low in both pour point and CFPP, and therefore a mixture of the ester and the polymer is excellent as a cold flow improver.

TABLE 2

| | No. | Cold flow improver | Addition amount (ppm) | CFPP (°C.) | Pour(1) point (°C.) |
|---|---|---|---|---|---|
| Cold flow improver of this invention | 36 | improver No. 1<br>polymer 1 | 200<br>200 | −12 | −15 |
| | 37 | improver No. 4<br>polymer 2 | 250<br>250 | −8 | −15 |
| | 38 | improver No. 6<br>polymer 3 | 300<br>200 | −6 | −15 |
| | 39 | improver No. 7<br>polymer 4 | 300<br>200 | −6 | −12.5 |
| | 40 | improver No. 8<br>polymer 5 | 250<br>250 | −6 | −15 |
| | 41 | improver No. 9<br>polymer 1 | 200<br>200 | −7 | −12.5 |
| | 42 | improver No. 11<br>polymer 2 | 200<br>300 | −11 | −12.5 |
| | 43 | improver No. 12<br>polymer 3 | 300<br>200 | −9 | −12.5 |
| | 44 | improver No. 13<br>polymer 4 | 250<br>250 | −9 | −12.5 |
| | 45 | improver No. 2<br>polymer 6 | 250<br>250 | −10 | −12.5 |
| Comparative cold flow improver | 46 | commercially available cold flow improver A (improver No. 33) | 500 | 0 | −15 |
| | 47 | commercially available cold flow improver B (improver No. 34) | 500 | 0 | −17.5 |
| | 48 | commercially available cold flow improver C (improver No. 35) | 500 | −1 | −17.5 |

Note:
(1)Measured according to JIS K 2269-1980

What is claimed is:

1. A method for improving the cold flow of fuel oils which comprises, adding to fuel oils, esters of (a) an addition product of an epoxide selected from the group consisting of alkylene oxide, styrene oxide and glycidol and compounds having the formula (1),

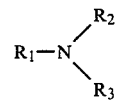

(1)

wherein $R_1$, $R_2$, and $R_3$ are selected from the group consisting of H—, $CH_3(CH_2)_n$—, $CH_3(CH_2)_nCO$—, —$CH_2CH_2OH$, —$CH(CH_3)CH_2OH$ and —$CH_2CH(OH)CH_2OH$, wherein n represents a number from 0 to 25 and at least one of $R_1$, $R_2$ and $R_3$ is selected from the group consisting of —$CH_2CH_2OH$, —$CH(CH_3)CH_2OH$ and —$CH_2CH(OH)CH_2OH$; and, (b) linear saturated fatty acids.

2. The method of claim 1, further comprising, adding polymers of at least one monomer selected from the group consisting of olefins, alkyl esters of ethylenically unsaturated carboxylic acids and vinyl esters of saturated fatty acids to said fuel oils.

3. The method of claim 1, wherein said compounds having the formula (1) are selected from the group consisting of methyldiethanolamine, ethyldiethanolamine, butyldiethanolamine, octyldiethanolamine, lauryldiethanolamine, stearyldiethanolamine, behenyldiethanolamine, methyldiisopropanolamine, butyldiisopropanolamine, stearyldiisopropanolamine, methylbis(dihydroxypropyl)amine, butylbis(dihydroxypropyl)amine, stearylbis(dihydroxypropyl)amine, dimethylmono(dihydroxypropyl)amine, dibutylmono(dihydroxypropyl)amine, distearylmono(dihydroxypropyl)amine, triethanolamine, triisopropanolamine, tris(dihydroxypropyl)amine, diethanolmono(dihydroxypropyl)amine and ethanolbis(dihydroxypropyl)amine.

4. The method of claim 1, wherein said compounds having the formula (1) are selected from the group consisting of diethanolamides and diisopropanolamides of fatty acids selected from the group consisting of acetic acid, propionic acid, butyric acid, hexanoic acid, octanoic acid, decanoic acid, lauric acid, myristic acid, palmitic acid, stearic acid, arachic acid, behenic acid and lignoceric acid.

5. The method of claim 1, wherein said linear saturated fatty acids have from 10 to 30 carbon atoms.

6. The method of claim 2, wherein said olefins have from 2 to 30 carbon atoms.

7. The method of claim 2, wherein said alkyl esters of ethylenically unsaturated carboxylic acids comprise esters of ethylenically unsaturated carboxylic acids and saturated alcohols having from 1 to 30 carbon atoms.

8. The method of claim 2, wherein said vinyl esters of saturated fatty acids comprise vinyl esters of saturated fatty acids having from 1 to 30 carbon atoms.

* * * * *